US008651830B2

(12) United States Patent
Shen

(10) Patent No.: US 8,651,830 B2
(45) Date of Patent: Feb. 18, 2014

(54) CENTRAL TUBULAR STRUCTURE OF A SHAFT SEAT AND FAN DEVICE THEREOF

(75) Inventor: Ching-Hang Shen, Sinjhuang (TW)

(73) Assignee: Asia Vital Components Co., Ltd., Sinjhuang, Taipei (TW)

( * ) Notice: Subject to any disclaimer, the term of this patent is extended or adjusted under 35 U.S.C. 154(b) by 229 days.

(21) Appl. No.: 12/855,711

(22) Filed: Aug. 13, 2010

(65) Prior Publication Data

US 2012/0039730 A1 Feb. 16, 2012

(51) Int. Cl.
*F04D 29/05* (2006.01)

(52) U.S. Cl.
USPC ..... 417/354; 417/423.14; 310/89

(58) Field of Classification Search
USPC ..... 417/354, 423.1, 353, 423.14; 310/89, 310/43; 29/596; 361/695
See application file for complete search history.

(56) References Cited

U.S. PATENT DOCUMENTS 4,337,405 A * 6/1982 Hishida ..... 310/43
5,492,458 A * 2/1996 Horng ..... 417/423.7
5,562,347 A * 10/1996 Hsieh ..... 384/215
6,394,767 B1 * 5/2002 Matsumoto ..... 417/423.1
7,259,486 B2 * 8/2007 Yamamoto ..... 310/90
7,635,934 B2 * 12/2009 Zhu et al. ..... 310/88
7,667,359 B2 * 2/2010 Lee et al. ..... 310/86
7,800,263 B2 * 9/2010 Horng et al. ..... 310/67 R
2005/0123423 A1 * 6/2005 Weisser ..... 417/423.7
2007/0014677 A1 * 1/2007 Chen et al. ..... 417/423.1
2007/0085426 A1 * 4/2007 Lee et al. ..... 310/43
2007/0145842 A1 * 6/2007 Zhu et al. ..... 310/88
2009/0189492 A1 * 7/2009 Horng et al. ..... 310/67 R

* cited by examiner

*Primary Examiner* — Devon Kramer
*Assistant Examiner* — Nathan Zollinger
(74) *Attorney, Agent, or Firm* — C. G. Mersereau; Nikolai & Mersreau, P.A.

(57) ABSTRACT

A central tubular structure of a shaft seat and a fan device thereof. The central tubular structure includes a base, a bushing connected with the base and a sealing member. The bushing has an outer tubular wall, an inner tubular wall and a top section interconnected between the outer and inner tubular walls to define a receiving space. The inner tubular wall defines a bearing hole. The bushing further has a reception space in adjacency to the base in communication with the receiving space and the bearing hole. The sealing member is fitted in the reception space to seal the same. The fan device is composed of the central tubular structure, a stator assembly, at least one bearing and a fan propeller. The stator assembly is arranged in the receiving space and has a substrate board. The substrate board is free from any perforation and received in the reception space.

9 Claims, 8 Drawing Sheets

CENTRAL TUBULAR STRUCTURE OF A SHAFT SEAT AND FAN DEVICE THEREOF

FIELD OF THE INVENTION

The present invention relates to a central tubular structure of a shaft seat and a fan device thereof, and more particularly to a central tubular structure of a shaft seat, in which the substrate board can be assembled with the shaft seat without any perforation. Therefore, the layout of the circuits on the substrate board is facilitated and the working time is greatly shortened to lower the manufacturing cost.

BACKGROUND OF THE INVENTION

Following the rapid development of various 3C products, the performances of all kinds of electronic components of the 3C products have been rapidly promoted to have faster and faster processing speed. The electronic components work at high speed and generate high heat at the same time. The heat must be efficiently dissipated outward. Otherwise, the temperature will rise very quickly to cause burnout of the electronic components. In order to avoid damage of the electronic components, in general, at least one heat dissipation unit (such as a radiating fin assembly or a heat sink) and a cooperative cooling fan are provided to dissipate the heat generated by the electronic components and thus prolong the lifetime thereof.

Please refer to FIG. 1, which is a perspective exploded view of a conventional fan device 8. The fan device 8 includes at least one fan propeller 81, at least one stator assembly 82, at least one bearing 83 and a shaft seat 84. The bearing 83 has a shaft hole 831. The shaft seat 84 has a bushing 841 for receiving the bearing 83 therein. The fan propeller 81 has a shaft 811 and multiple blades 812. The shaft 811 is inserted in the shaft hole 831 of the bearing 83. The stator assembly 82 has a silicon steel sheet assembly 821 and at least one substrate board 822. The substrate board 822 is connected to one side of the silicon steel sheet assembly 821. Multiple control circuits are arranged on the substrate board 822. The stator assembly 82 is press-fitted around the bushing 841 of the shaft seat 84. Therefore, the silicon steel sheet assembly 821 of the stator assembly 82 must be formed with a central perforation 8211 and the substrate board 822 must be also formed with a central perforation 8221. By means of the perforations 8211, 8221, the stator assembly 82 can be securely fitted around the bushing 841 and coupled with the shaft seat 84. However, the multiple control circuits arranged on the substrate board 822 must avoid the perforation 8221 of the substrate board 822. As a result, the space for the layout of the control circuits is limited and it is hard to deploy the control circuits of the fan device. Moreover, a large amount of material of the substrate board is wasted. According to the aforesaid, the conventional fan device has the following defects:

1. It is hard to deploy the circuits.
2. The space for the layout of the circuits is limited.
3. A large amount of material is wasted.

SUMMARY OF THE INVENTION

A primary object of the present invention is to provide a central tubular structure of a shaft seat, in which the substrate board can be assembled with the shaft seat without any perforation.

A further object of the present invention is to provide a fan device composed of the central tubular structure, a stator assembly, at least one bearing and a fan propeller.

To achieve the above and other objects, the central tubular structure of the shaft seat of the present invention includes a base, a bushing and a sealing member. The bushing is connected with the base and has an outer tubular wall, an inner tubular wall and a top section. The top section is interconnected between the outer and inner tubular walls to together define a receiving space. The inner tubular wall defines therein a bearing hole having an open end in adjacency to the top section. The bushing further has a reception space in adjacency to the base. The reception space has a first end opposite to the top section in communication with the receiving space and the bearing hole. The reception section further has a second end in adjacency to the base. The sealing member is fitted in the reception space to seal the second end thereof.

The fan device is composed of the central tubular structure of the shaft seat, a stator assembly, at least one bearing and a fan propeller. The stator assembly is arranged in the receiving space and has at least one substrate board. The substrate board is free from any perforation and received in the reception space.

The substrate board can be assembled with the shaft seat without any perforation. Therefore, the layout of the circuits on the substrate board is facilitated and the working time is greatly shortened to lower the manufacturing cost. According to the aforesaid, the present invention has the following advantages:

1. It is easy to assemble the present invention.
2. The manufacturing cost of the present invention is lowered.
3. The structure of the present invention is simple.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
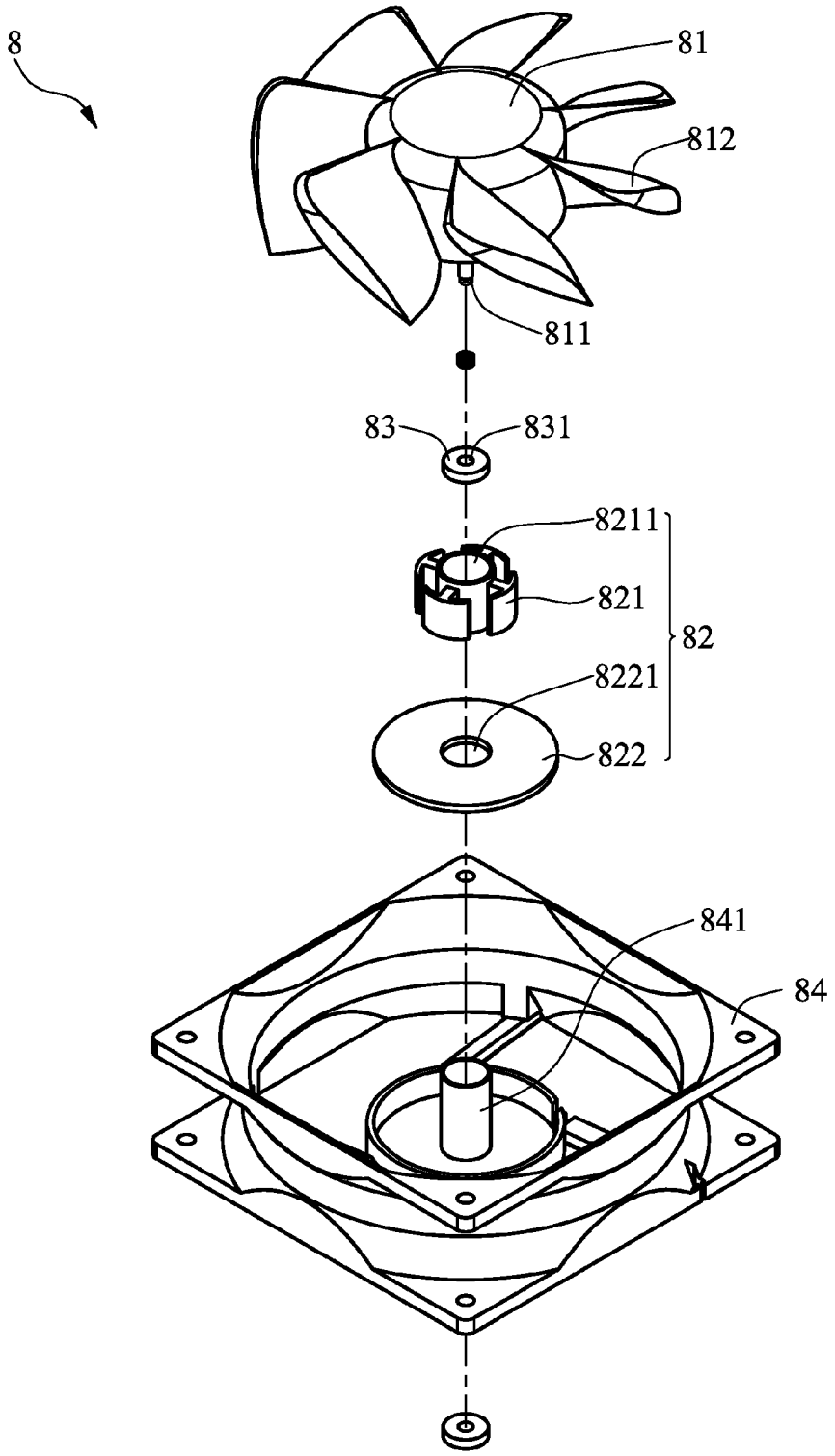
Fig. 1(PRIOR ART)
FIG. 1 is a perspective exploded view of a conventional fan device.
Figure 2:
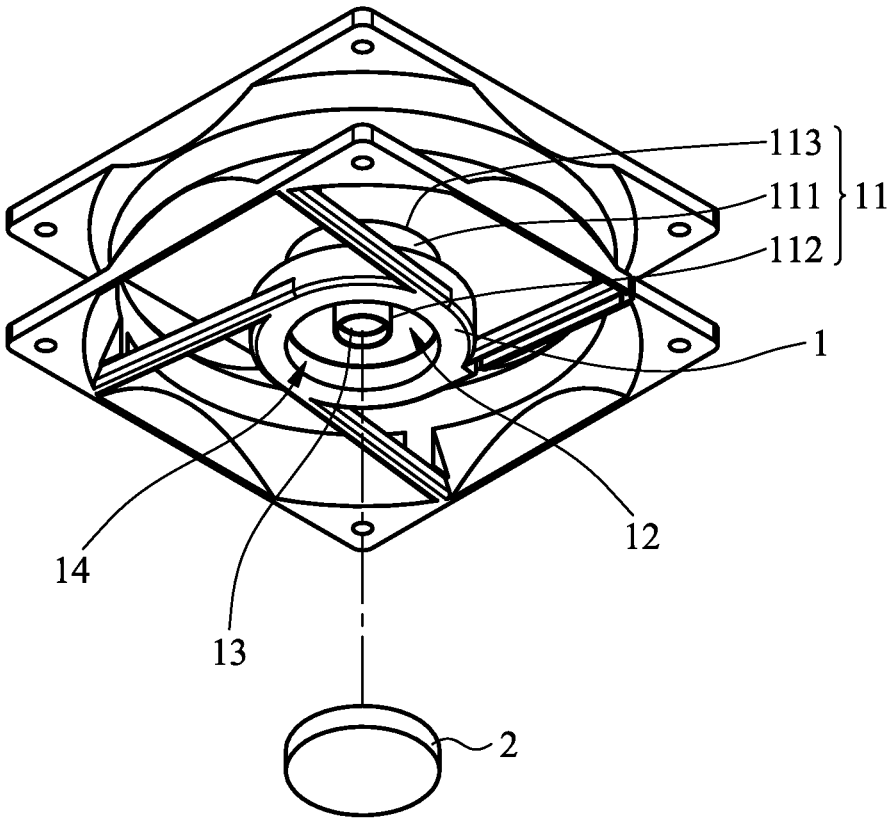
FIG. 2 is a perspective exploded view of the central tubular structure of the shaft seat of the present invention.
Figure 3:
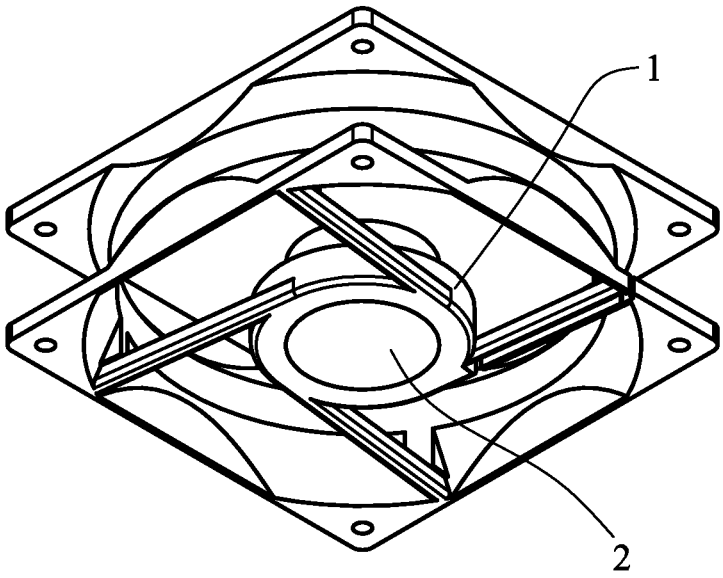
FIG. 3 is a perspective assembled view of the central tubular structure of the shaft seat of the present invention.
Figure 4:
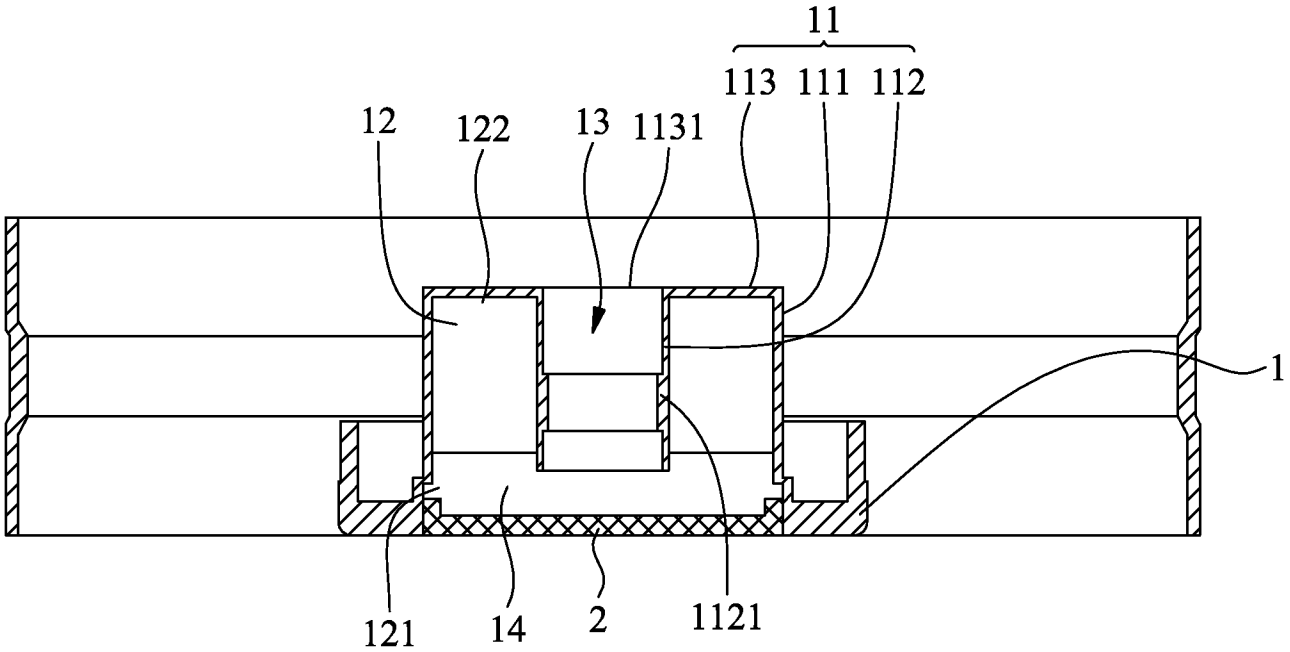
FIG. 4 is a sectional assembled view of the central tubular structure of the shaft seat of the present invention.

Please refer to FIGS. 2, 3 and 4. The central tubular structure of the shaft seat of the present invention is applied to a fan device. The central tubular structure of the shaft seat includes a base 1, a bushing 11 and a sealing member 2. The bushing 11 is connected with the base 1, having an outer tubular wall 111, an inner tubular wall 112 and a top section 113. The top section 113 is interconnected between the outer and inner tubular walls 111, 112 to together define a receiving space 12. The inner tubular wall 112 defines therein a bearing hole 13 having an open end 1131 in adjacency to the top section 113. The bushing 11 further has a reception space 14 in adjacency to the base 1. The reception space 14 has a first end opposite to the top section 113 in communication with the receiving space 12 and the bearing hole 13. The reception section 14 further has a second end in adjacency to the base 1. The sealing member 2 is fitted in the reception space 14 to seal the second end thereof.

The base 1 and the bushing 11 are integrally formed. The receiving space 12 has an open side 121 and a closed side 122. The open side 121 communicates with the reception space 14. An annular raised section 1121 is formed on inner circumference of the inner tubular wall 112 of the bushing 11. At least one bearing 3 is rested on one side of the annular raised section 1121 (as shown in FIG. 4).

Figure 5:
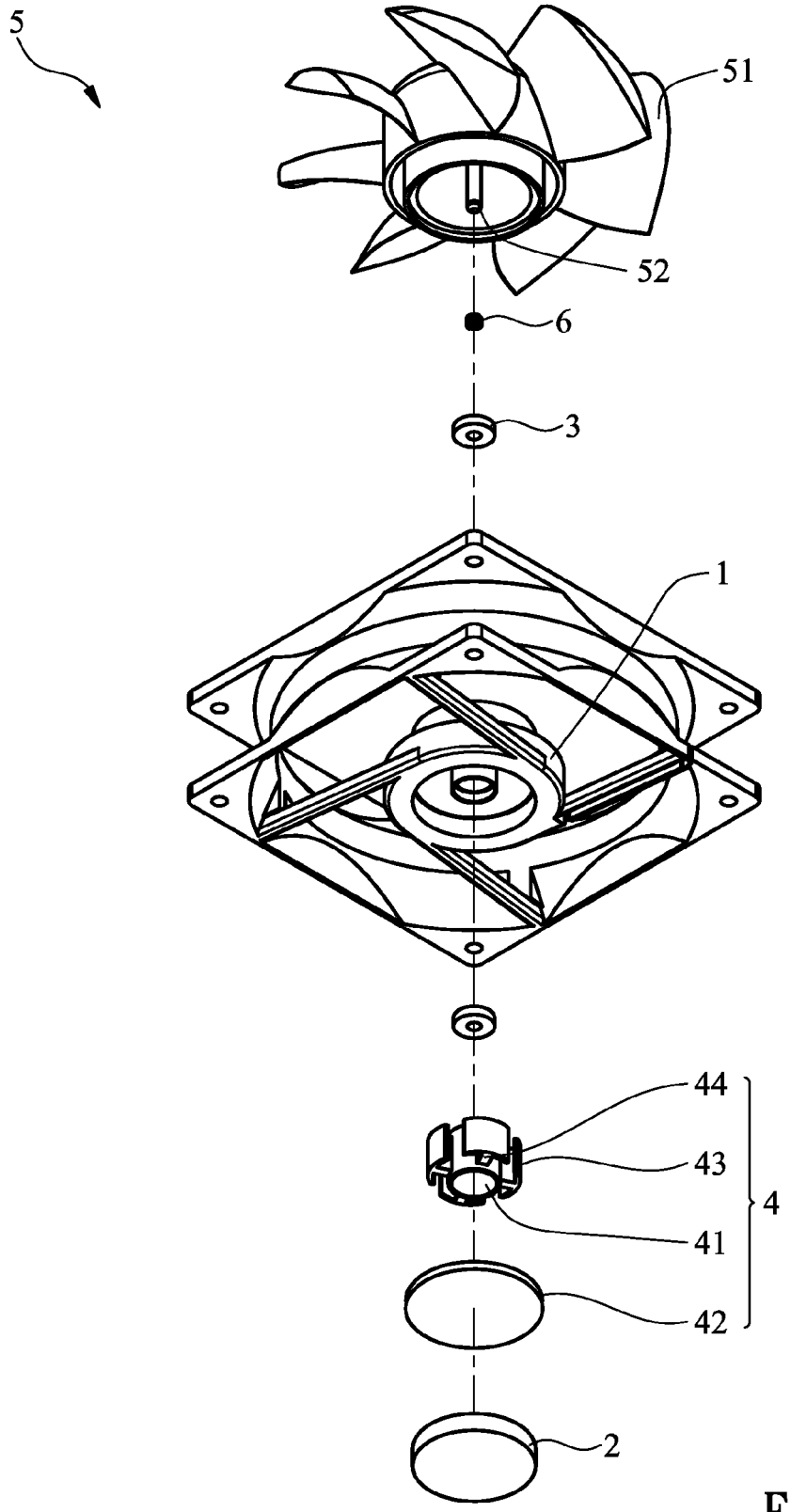
FIG. 5 is a perspective exploded view of the fan device of the present invention.
Figure 6:
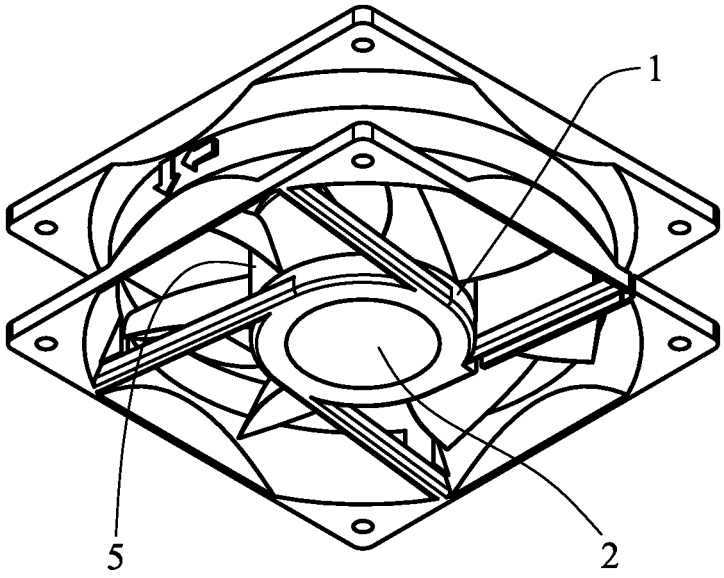
FIG. 6 is a perspective assembled view of the fan device of the present invention.
Figure 7:
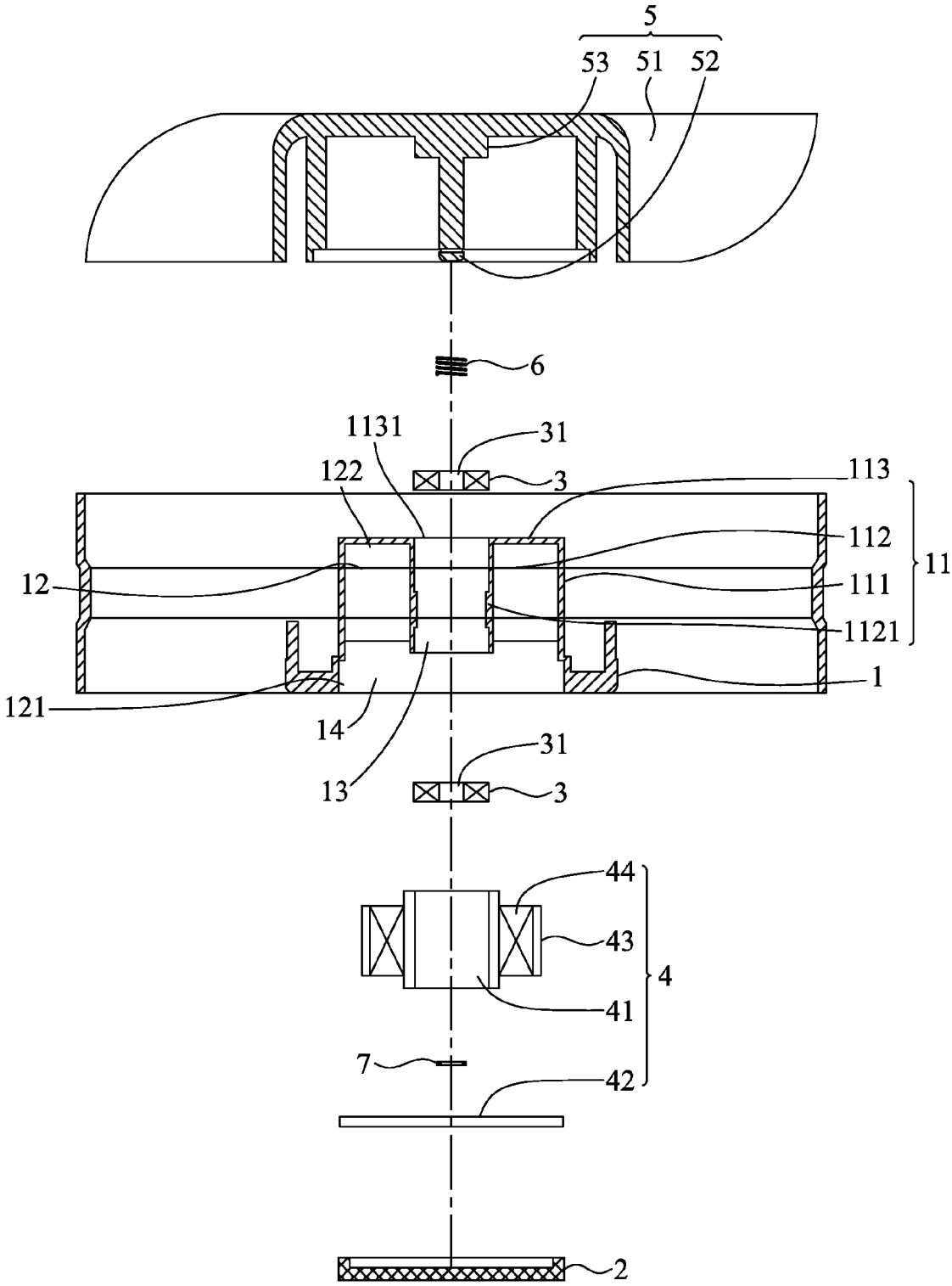
FIG. 7 is a sectional exploded view of the fan device of the present invention.
Figure 8:
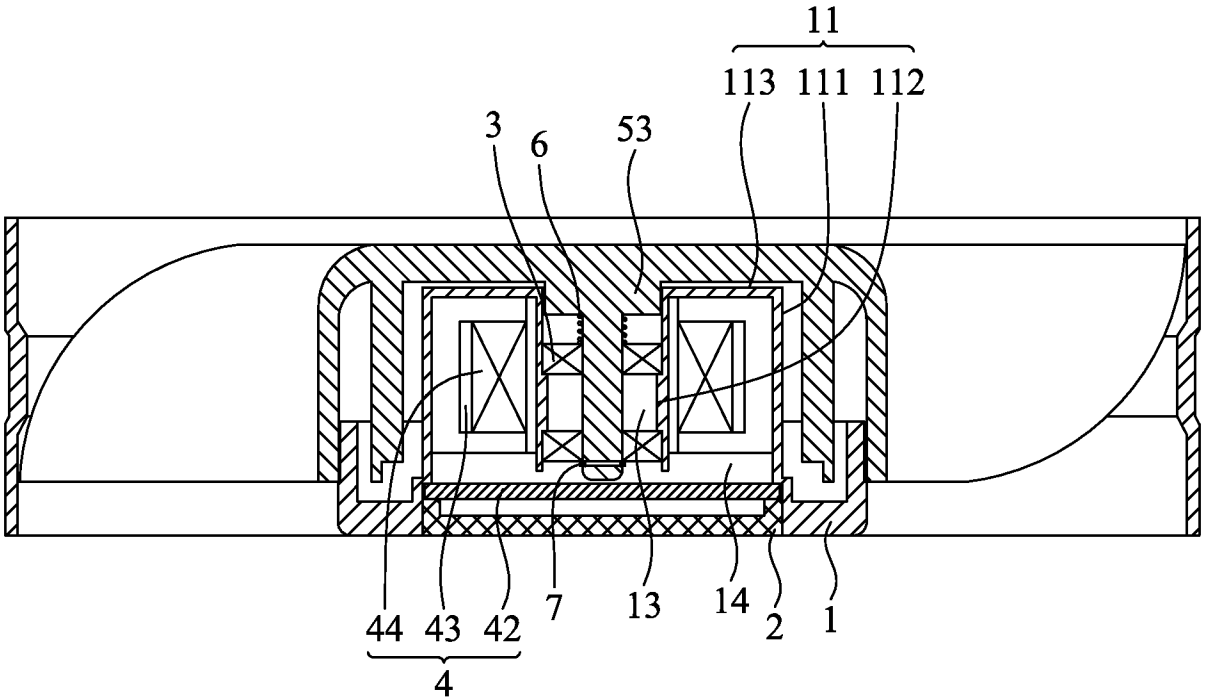
FIG. 8 is a sectional assembled view of the fan device of the present invention.

Please refer to FIGS. 5, 6 and 7. The fan device of the present invention includes a base 1, a bushing 11, a stator assembly 4, at least one bearing 3, a fan propeller 5 and a sealing member 2. The bushing 11 is connected with the base 1, having an outer tubular wall 111, an inner tubular wall 112 and a top section 113. The top section 113 is interconnected between the outer and inner tubular walls 111, 112 to together define a receiving space 12. The inner tubular wall 112 defines therein a bearing hole 13 having an open end 1131 in adjacency to the top section 113. The bushing 11 further has a reception space 14 in adjacency to the base 1. The reception space 14 has a first end opposite to the top section 113 in communicates with the receiving space 12 and the bearing hole 13. The stator assembly 4 is arranged in the receiving space 12 and has a through hole 41 and at least one substrate board 42. The bearing 3 is installed in the bearing hole 13 of the bushing 11 and has a shaft hole 31. The fan propeller 5 has multiple blades 51 and at least one shaft 52 inserted in the shaft hole 31 of the bearing 3. The reception section 14 further has a second end in adjacency to the base 1. The sealing member 2 is fitted in the reception space 14 to seal the second end thereof.

The receiving space 12 has an open side 121 and a closed side 122. The open side 121 communicates with the reception space 14.

The stator assembly 4 has multiple silicon steel sheets 43 and multiple windings 44. The substrate board 42 is positioned under the stator assembly 4 in abutment with one face of the sealing member 2. The substrate board 42 can be formed with a perforation or free from any perforation.

The fan propeller 5 further has a shaft shoulder section 53. At least one resilient member 6 such as a spring is positioned between the shaft shoulder section 53 and the bearing 3. In addition, a free end of the shaft 52 is provided with a C-shaped retainer ring 7.

The above embodiment is only used to illustrate the present invention, not intended to limit the scope thereof. It is understood that many changes and modifications of the above embodiment can be made without departing from the spirit of the present invention. The scope of the present invention is limited only by the appended claims.

What is claimed is:

1. A central tubular structure of a shaft seat, which is applied to a fan device, the central tubular structure of the shaft seat comprising:

a base;

a bushing connected with the base, having an outer tubular wall, an inner tubular wall and a top section, the top section being a continuous flat plate member interconnected between the outer and inner tubular walls to together define an annular receiving space, the inner tubular wall defining therein a bearing hole having an open end in adjacency to the top section, the bushing further having a reception space in adjacency to the base, the reception space having a first end opposite to the top section in communication with the annular receiving space and the bearing hole, the reception space further having a second end in adjacency to the base;

a sealing member fitted in the reception space to seal the second end thereof; and wherein an integral annular raised section is formed on an inner circumference of the inner tubular wall of the bushing;

a pair of spaced bearings one bearing being rested on each side of the annular raised section.

2. The central tubular structure of the shaft seat as claimed in claim 1, wherein the receiving space has an open side and a fully closed side, the open side communicating with the reception space.

3. The central tubular structure of the shaft seat as claimed in claim 1, wherein the base and the bushing are integrally formed.

4. A fan device comprising:

a base;

a bushing connected with the base, having an outer tubular wall, an inner tubular wall and a top section, the top section being a continuous flat plate member interconnected between the outer and inner tubular walls to together define an annular receiving space, the inner tubular wall defining therein a bearing hole having an open end in adjacency to the top section, the bushing further having an annular raised section on an inner circumference of the inner tubular wall for at least one bearing to rest thereon and a reception space in adjacency to the base, the reception space having a first end opposite to the top section in communication with the annular receiving space and the bearing hole, the reception space further having a second end in adjacency to the base;

a stator assembly arranged in the annular receiving space and having a through hole and at least one substrate board;

a pair of spaced bearings installed in the bearing hole of the bushing, one resting on each side of said annular raised section with each bearing having a shaft hole;

a fan impeller having multiple blades and at least one shaft inserted in the shaft hole of each bearing;

a sealing member fitted in the reception space to seal the second end thereof;

wherein the fan impeller further has a shaft shoulder section, at least one resilient member being positioned between the shaft shoulder section and the at least one bearing; and wherein the stator assembly has multiple silicon steel sheets and multiple windings, the substrate board being positioned under the stator assembly.

5. The fan device as claimed in claim 4, wherein the receiving space has an open side and a fully closed side, the open side communicating with the reception space.

6. The fan device as claimed in claim 4, wherein the substrate board of the stator assembly abuts against one face of the sealing member.

7. The fan device as claimed in claim 4, wherein the substrate board is formed with a perforation or free from any perforation.

8. The fan device as claimed in claim 4, wherein the resilient member is a spring.

9. The fan device as claimed in claim 4, wherein a free end of the shaft is provided with a C-shaped retainer ring.

* * * * *